US006633227B1

(12) United States Patent
Schmitz

(10) Patent No.: US 6,633,227 B1
(45) Date of Patent: Oct. 14, 2003

(54) METHOD FOR OPERATING A REMOTE CONTROL, AND REMOTE CONTROL

(75) Inventor: Stefan Schmitz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/485,378

(22) PCT Filed: Aug. 5, 1998

(86) PCT No.: PCT/DE98/02253

§ 371 (c)(1),
(2), (4) Date: May 9, 2000

(87) PCT Pub. No.: WO99/08471

PCT Pub. Date: Feb. 18, 1999

(30) Foreign Application Priority Data

Aug. 8, 1997 (DE) ..... 197 34 341

(51) Int. Cl.[7] ..... G50B 19/00

(52) U.S. Cl. ..... 340/10.31; 340/825.69; 340/825.72

(58) Field of Search ..... 340/825.69, 825.72, 340/5.2

(56) References Cited

U.S. PATENT DOCUMENTS

| | | | | | |
|---|---|---|---|---|---|
| 5,266,925 | A | | 11/1993 | Vercellotti | 340/572 |
| 5,640,151 | A | * | 6/1997 | Reis et al. | 340/825.54 |
| 5,781,106 | A | * | 7/1998 | Liger | 340/505 |
| 5,822,714 | A | * | 10/1998 | Cato | 702/108 |
| 6,172,596 | B1 | * | 1/2001 | Cesar et al. | 340/10.41 |
| 6,177,858 | B1 | * | 1/2001 | Raimbault et al. | 340/10.1 |

FOREIGN PATENT DOCUMENTS

| | | |
|---|---|---|
| DE | 197 43 101 | 5/1998 |
| EP | 0 322 701 | 7/1989 |
| GB | 2 116 808 | 9/1983 |

* cited by examiner

*Primary Examiner*—Michael Horabik
*Assistant Examiner*—Matsuichiro Shimizu
(74) *Attorney, Agent, or Firm*—Kenyon & Kenyon

(57) ABSTRACT

A method of allocating a remote control to a base station. The base station delivers a search signal. The remote control receives the search signal, compares it with a reference signal, and delivers a contact signal if they match. On receiving certain contact signals in response, the base station then delivers an identification signal, and after receiving it, the remote control sends back to the base station a code signal identifying it unambiguously.

10 Claims, 3 Drawing Sheets

METHOD FOR OPERATING A REMOTE CONTROL, AND REMOTE CONTROL

BACKGROUND INFORMATION

The present invention relates to a method like that described in German Patent Application 196 45 769 (non-published). According to that method, a remote control is allocated to a base station arranged in a motor vehicle by having the base station transmit a search signal, whereupon any remote controls within the field of range of the search signal respond by sending back a contact signal at times characteristic of the remote controls. By analyzing the receipt times of the contact signal acknowledgments, the base station determines which remote controls are present. It selects one of them to perform a challenge/response verification with it. Since the information about which remote controls are present is not contained in the contact signal but in the time of its return, the contact signal may have a simple structure, and thus the entire identification can take place very rapidly. The identification speed is determined only by the number of time windows made available for the individual remote controls. However, if a base station is to be allocated a very large number of remote controls, this method loses its advantage of being fast.

SUMMARY OF THE INVENTION

An object of the present invention is to provide a method and a device suitable for carrying it out, permitting an allocation of a large number of remote controls to one base station and performing the allocation rapidly.

The method according to the present invention makes it possible to allocate a large number of remote controls to one base station with no change in the high allocation identification speed by allocating multiple remote controls to individual time slots. The number of time slots may be kept low, and the allocation identification speed may be kept high. An additional control signal with which the base station prompts the remote controls to transmit their device codes is advantageously used to differentiate multiple remote controls responding in the same time slot. The base station uses the interpretability of the device codes sent back as identification information. To select a certain remote control, the remote controls are induced to deliver random contact signals, with the first remote control responding unambiguously being selected. Therefore, the unambiguous identification of a remote control is made rapidly with only a few steps even when there are multiple remote controls assigned to the same time slot within the range of the base station.

DETAILED DESCRIPTION

Figure 1:
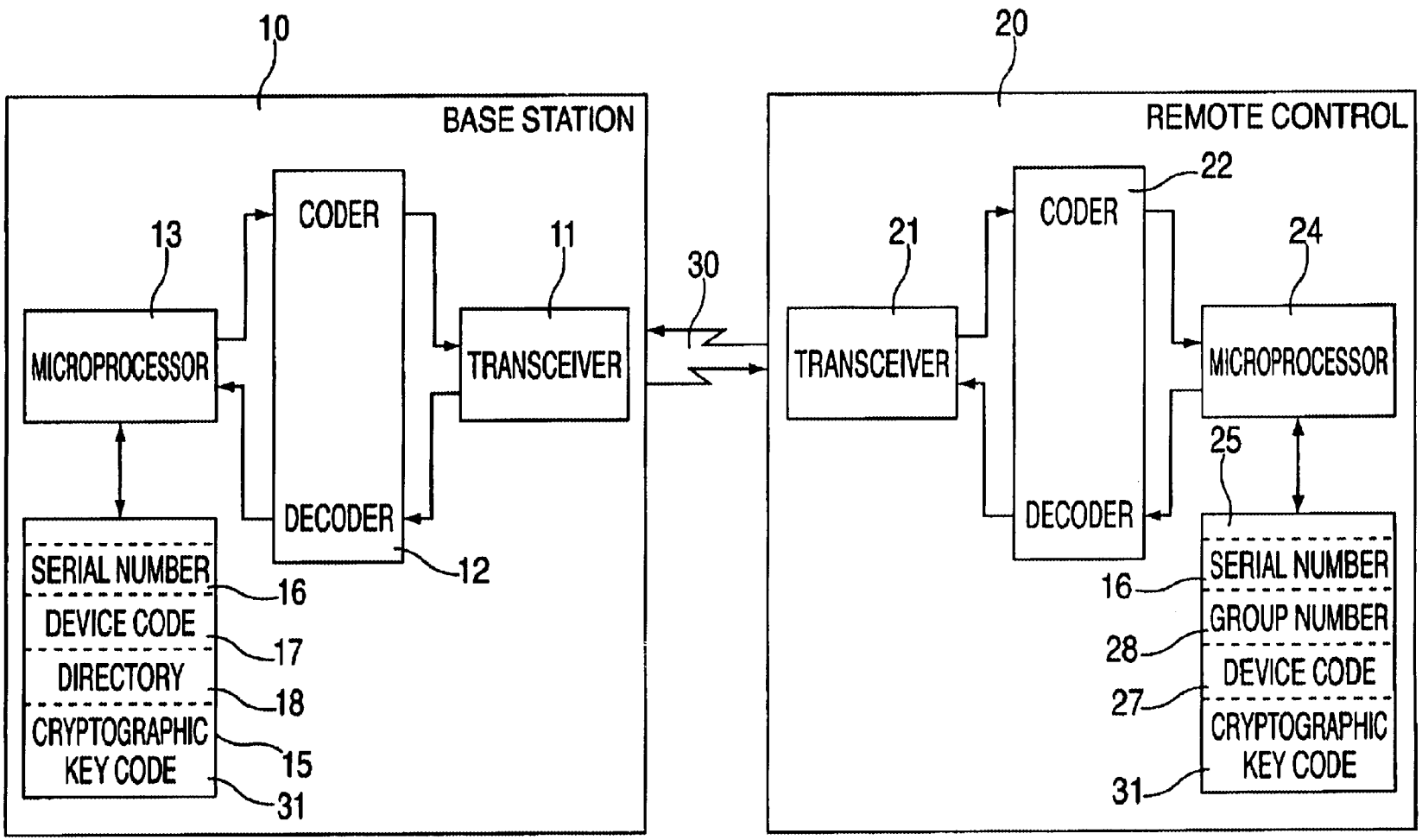
FIG. 1 shows a block diagram of an allocation arrangement.

In FIG. 1, reference number 10 denotes a base station, which may be part of a device or an object or is fixedly allocated to such. For example, the base station may be part of the access control equipment of a building or a motor vehicle. Reference number 20 denotes an operating device, referred to below as a remote control, which is functionally allocated to base station 10 via a signal transmission link 30 in a non-contact method. Remote control 20 may be a transponder, for example. Base station 10 acts by way of linkages (not shown) on the technical device to whose part or to which it is allocated.

The core of base station 10 is a microprocessor 13 which monitors and prompts the output of signals by base station 10 in particular and analyzes incoming signals. It is connected by a coder/decoder unit 12 to a transceiver 11 for delivering and receiving signals transmitted over signal transmission link 30 in a non-contact method. Coding/decoding unit 12 is used to encode/decode the signals exchanged between microprocessor 13 and transceiver 11. Microprocessor 13 has a memory 15 containing a serial number 16, a device code 17, a cryptographic key code 31 as well as a directory 18 that includes the group numbers as well as device codes 27 allocated to the group numbers and belonging to remote controls 20 allocated to base station 10. Device code 17 identifies the respective device, i.e., base station 10 unambiguously. It is issued to the base station by the manufacturer and cannot be altered. Serial number 16 is characteristic of mutually allocated base stations 10 and remote controls 20. Group numbers 28 entered in directory 18 differentiate remote controls 20 allocated to a base station 10 and having the same serial numbers; device code 27 allocated in each case in combination with the cryptographic key code 31 is used to verify a remote control 20 belonging to the group number. Equivalent to separate storage of cryptographic key code 31 and device code 27, a combination of the two used in verification may also be stored directly in directory 18. Furthermore, directory 18 also contains device codes 27 of remote controls that are no longer allowed, e.g., because they have been lost or stolen Serial numbers 16 are issued by the manufacturer of the technical equipment and allocated to base station 10 and remote controls 20. When using the arrangement in motor vehicles, this assignment can be made by the automotive manufacturer, who will also determine cryptographic key code 31 by means of which it is possible to verify that a remote control 20 belongs to base station 10.

Remote control 20 has a transceiver 21 corresponding to transceiver 11 assigned to the base station for receiving signals transmitted by base station 10 and for relaying signals transmitted in a non-contact method to base station 10. Like the base station, a coding/decoding unit 22 is connected downstream from transceiver 21 for encoding/decoding coded signals. A microprocessor 24 connected to coding/decoding unit 22 performs the analysis of the signals received by transceiver 21, initiates subsequent measures depending on the results and monitors output of output signals. A memory unit 25 is provided for microprocessor 24. It has a memory location for storing serial number 16, a memory location for storing a device code 27, a memory location for storing a group number 28 and a memory location for storing a cryptographic key code 31. The meaning of the memory contents here corresponds to the meaning of similar memory contents in memory 15 of base station 10. Serial number 16 is a code that is characteristic of the device as a whole composed of base station 10 and respective operating elements 20 and is identical to the serial number contained in memory 15 of base station 10. Group number 28 is used to differentiate remote controls 20 having the same serial number. It is assigned by the user in using the device as a whole. Device code 27 is issued by the manufacturer of remote control 20 and identifies it unambiguously. Cryptographic key code 31 is identical to the key code in base station 10 and is used to verify that a given remote control belongs to a base station 10. It is issued by the manufacturer of the technical equipment belonging to base station 10.

There is a signal transmission link 30 between base station 10 and remote control 20 for transmitting signals without contact between transceiver 21 in the remote control and transceiver 11 in the base station. Signals transmitted by transceiver 11 in the base station reach all remote controls 20 within its range simultaneously. Infrared signals or high-frequency signals are advantageously used as the signals.

Multiple remote controls 20 may be allocated to one base station 10. All allocated remote controls 20 and base station 10 itself have an identical serial number 16 in their memories 15, 25 and use an identical cryptographic key code 31 in the verification. Individual remote controls 20 are differentiated by their group numbers. They are usually simply issued so that a remote control is unambiguously identified by group number 28. Specific group numbers may also be assigned to multiple remote controls 20 at the same time. Such remote controls 20 provided with an identical group number 28 differ in their device code 27.

Figure 2:
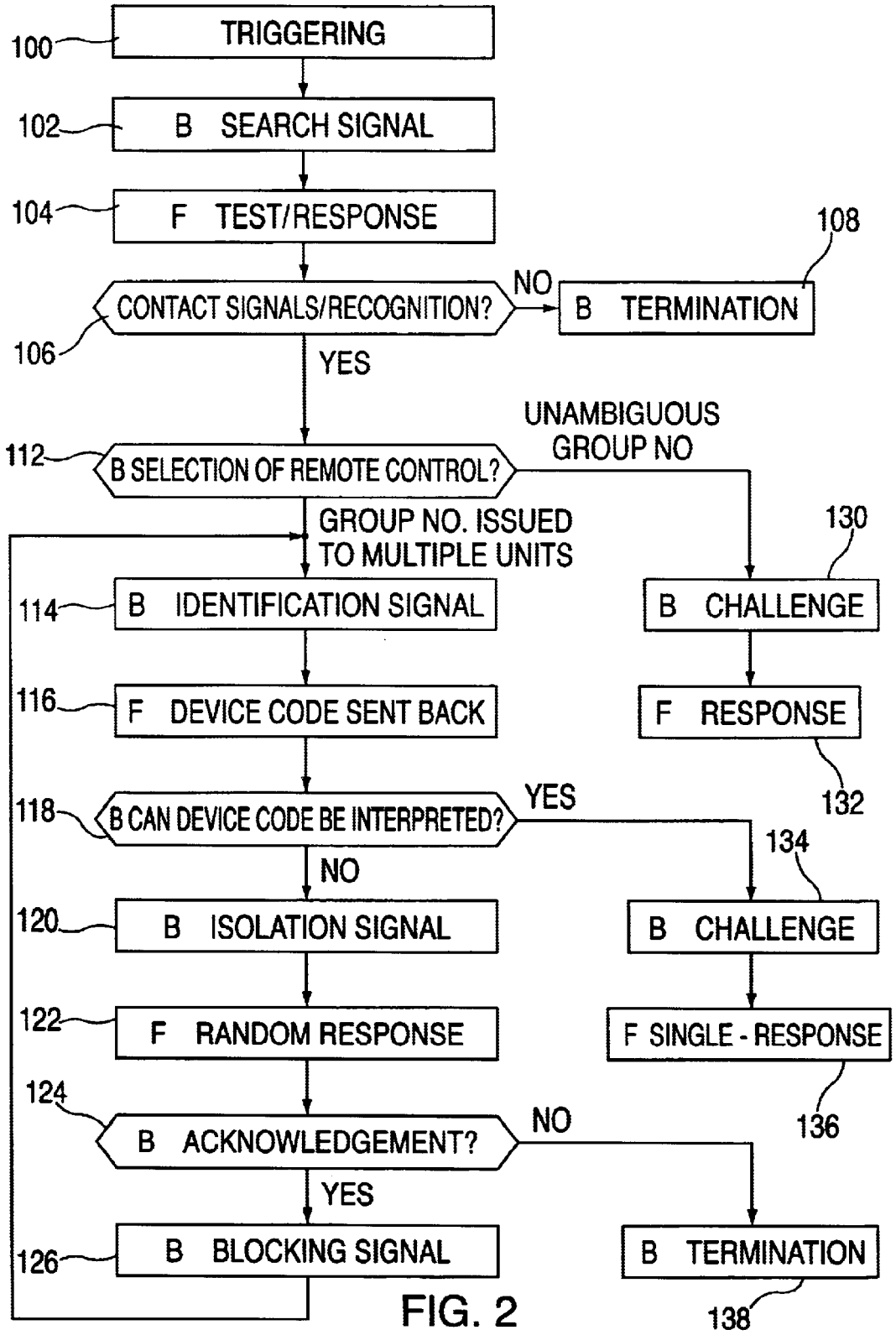
FIG. 2 shows a flow chart illustrating an operation of the allocation arrangement.

The functioning of the device shown in FIG. 1 is explained below on the basis of FIGS. 2 and 3. The method steps in FIG. 2 are each preceded by a letter B or F, indicating whether the respective step takes place in base station 10: B or in remote control 20: F.

Figure 4:
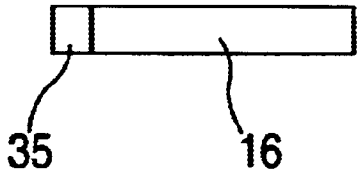
FIG. 4 shows the structure of a search signal.

The allocation identification process is (usually) initiated by a user by operating a mechanical, electrical or electro optical triggering mechanism (not shown) (step 100). When used in conjunction with a motor vehicle, the triggering mechanism may involve operation of the door handle, for example. On the basis of a signal delivered after this triggering, microprocessor 13 of base station 10 initiates the delivery of a search signal by transceiver 11 (step 102). As indicated in FIG. 4, the search signal contains a starting frequency 35, preferably implemented as a start bit, and serial number 16 stored in memory 15. It is preferably unencoded. The search signal is received by all remote controls 20 within the range of signal transmission link 30 via their transceivers 21. On receipt of a search signal, their microprocessors 24 check on whether serial number 16 transmitted with the search signal matches serial number 16, which is used as a reference signal and is stored in memory 25 of remote control 20. Start bit 35 which is also transmitted is used to synchronize microprocessor 24 with the received search signal. If microprocessor 24 finds a match between the received serial number and the serial number present in memory 25, it initiates output of a response in the form of a contact signal (step 104). A short signal with a simple structure, e.g., the group number of respective remote control 20 in bit-coded form is used as the contact signal. It is preferably unencoded, like the search signal. Microprocessor 24 causes the search signal to be transmitted after expiration of a period of time after receipt of the search signal, the period of time, characteristic of operating element 20, being determined by the group number. This takes place in a time window of a predetermined length. The transmission is of such a length that reliable allocation of a contact signal to a time window is possible for both remote control 20 and base station 10.

Figure 3:
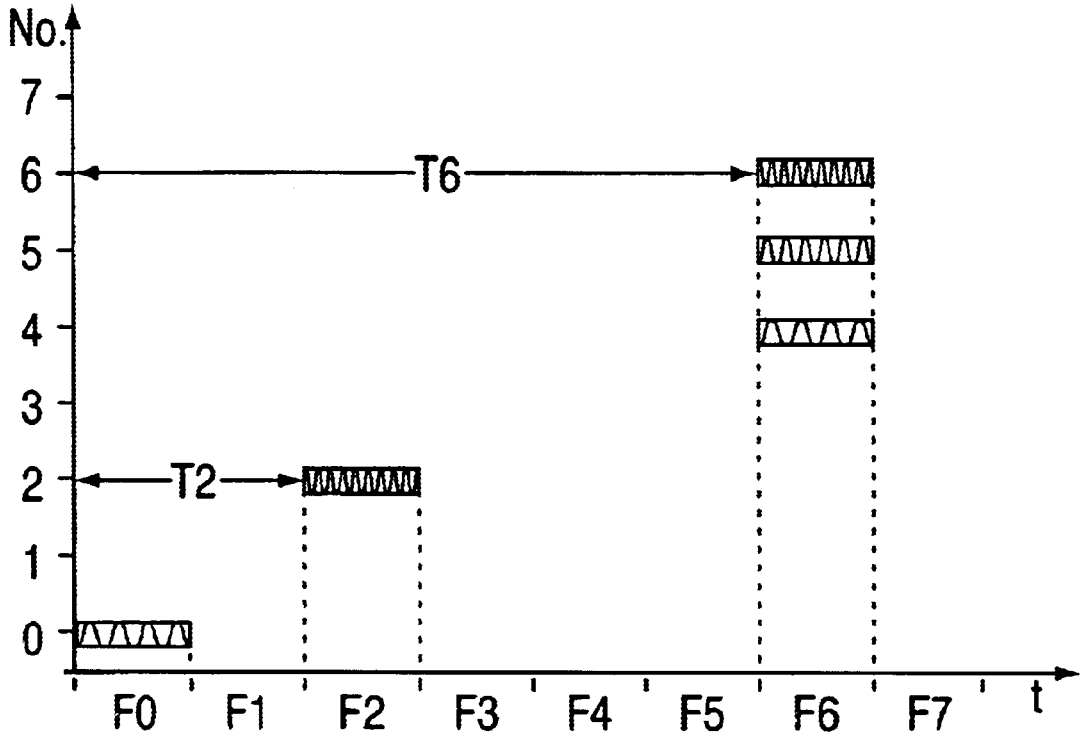
FIG. 3 shows the principle of time slot allocation.

FIG. 3 illustrates in the form of a graph the behavior of remote controls 20 in response to a search signal. The abscissa represents a time axis t subdivided into, for example, eight time windows F0, . . . , F7, beginning with receipt of the search signal in remote controls 20. The ordinate shows group number 28 of the respective remote control 20. In FIG. 3, eight group numbers 0 through 7 are assigned to one base station 10. Let us assume that there is one remote control with each of group numbers 0 and 2 as well as three remote controls having group number 7. They all respond to the search signal by transmitting a contact signal according to step 104. In this example, let us assume that the time of transmission of the contact signal, i.e., the ordinal number of the respective time signal, corresponds to the group number of the respective remote control. Therefore, the remote control having group number 2 transmits its contact signal in time window F2 after waiting time T2, the remote controls having group number 6 transmit their contact signals in time window F6 after waiting time T6. Consequently, transceiver 11 of base station 10 receives two staggered contact signals appearing in windows F2 and F6, indicating directly which remote controls 20 designated by their group numbers are within the range of signal transmission link 30.

By determining whether and in which time windows F0 through F7 contact signals have been received, microprocessor 13 determines which remote controls 20 are present (step 106). Remote controls 20 that are present are noted by appropriate entries in memory 15. If no remote control 20 is found to be present, a termination signal is issued (step 108), terminating the identification attempt.

After determining which remote controls 20 are present, microprocessor 13 makes a selection determining with which of them a verification of the allocation is to be made (step 112). In doing so, it checks first to determine whether remote controls 20 designated unambiguously by group numbers issued only once are present. If this is the case, it selects one of them for the subsequent verification communication. The basis for this selection may be, for example, a ranking of remote controls 20 on the basis of which the remote controls are given different function ranges, for example.

The selected remote control 20 subjects base station 10 to an accuracy test. This test is performed in the manner of the known challenge/response procedure. Base station 10 sends a random number generated for this purpose as a challenge to remote control 20 (step 130). At the same time, microprocessor 13 forms a desired response signal according to a preset algorithm from device code 28 of the respective remote control 20 stored in directory 18, cryptographic key code 31 and the random number. Meanwhile, the challenge signal sent to remote control 20 is received by its transceiver 21 and relayed to microprocessor 24. The microprocessor derives a response signal from the received challenge signal in the same way as microprocessor 13 of base station 10 and sends it back to base station 10 (step 132). After receiving the response signal sent back, microprocessor 13 compares it with the desired response signal determined previously and delivers an enable signal if they match or it delivers a blocking signal if they do not match. A blocking signal is delivered in particular when device code 27 contained in the response signal belongs to a remote control 20 which has been blocked, e.g., due to loss or theft.

If the analysis of remote controls 20 that are present in step 112 reveals that only remote controls 20 with group numbers 28 issued to multiple devices are present, microprocessor 13 causes an identification signal to be delivered by transceiver 11 (step 114). It causes microprocessors 24 of remote controls 20 that are present to respond by sending back device codes 27 that are present in memories 25. All remote controls 20 that are present respond at the same time (step 116). Microprocessor 13 of base station 10 then checks the device codes sent back in response to transmission of a separation signal to determine whether the signal received on the whole corresponds in form to a device code and can be identified with a device code stored in memory 15 (step 118). If that is the case, then only a single remote control 20 with a group number issued to multiple devices is present. Microprocessor 13 then continues to perform a simplified verification communication procedure. To do so, it sends remote control 20 a challenge signal represented by a random number (step 134) and at the same time it generates a desired response signal from the random number by linking it with cryptographic key code 31. Meanwhile, remote control 20 proceeds in the same way with the challenge signal sent. It sends the resulting encoded signal back to base station 10 (step 136). Its microprocessor 13 compares the response signal received back with the desired response signal determined previously and delivers an enable signal if they match or a blocking signal if they do not match.

If the check of the signal received on the whole in step 118 reveals that it cannot be interpreted as an unambiguously identifiable device code, microprocessor 13 causes a separation signal to be sent (step 120). It is received by remote controls 20 and relayed to their respective microprocessors 24. The separation signal causes it to deliver a contact signal in a randomly selected time window not linked to group number 28. After receiving a separation signal, microprocessors 24 of remote controls 20 each cause the randomly controlled selection of a time window (step 122). To do so, they link device code 27 present in memory 25, for example, with a random number generated by the microprocessor or sent previously by base station 10. It then prepares the return of the contact signal for the randomly selected time window.

Meanwhile, microprocessor 13 of base station 10 awaits the receipt of the first contact signal (step 124). As soon as it detects receipt of the first contact signal, it no longer accepts any other incoming contact signals. At the same time, it causes a control signal to be sent (step 126), which in turn blocks transmission of other prepared contact signals by remote controls 20 in subsequent time windows. Remote controls 20 which have been prevented from sending signals no longer participate in the following communication. Then, microprocessor 13 again causes an identification signal to be sent (step 114) to the remote controls 20 still participating in the communication. They respond in turn by sending back their device codes (step 116) which are analyzed by microprocessor 13 at base station 10 for unambiguous interpretability. If it finds that the response signal received in response to transmission of the separation signal can be interpreted unambiguously and can be allocated to a device code 17 stored in memory 15, microprocessor 13 proceeds in performing the allocation accuracy test according to step 130. If no unambiguous interpretability is found with the test in step 118, microprocessor 13 repeats steps 114 through 126 until the test in step 128 yields an unambiguously identifiable device code. If, in running through the loop defined by steps 114 through 126, microprocessor 13 finds that no response signal has been received in response to an identification signal, it interrupts the allocation communication (step 138) and/or it causes additional suitable subsequent measures to be taken.

The method and the device described here can be further embodied and modified while retaining the basic idea of allowing multiple occupancy of individual time windows in an allocation based on the time window principle and permitting identification of a remote control belonging to a multiply occupied time window by analyzing a signal delivered simultaneously by all the remote controls that are present to determine whether it is interpretable. For example, this is true of the structure of the base stations of the remote controls or for the number and sequence of method steps. For example, after determining which remote controls are present, all those identified as present may be verified.

What is claimed is:

1. A method of allocating a remote control to a base station, comprising the steps of:

causing the base station to deliver a search signal;

causing the remote control to receive the search signal;

causing the remote control to compare the search signal with a reference signal;

if the search signal matches the reference signal, causing the remote control to deliver a contact signal after a period of time that is determined by a group number and that is characteristic of the remote control has elapsed;

causing the base station to deliver an identification signal after the contact signal is received;

causing the remote control to receive the identification signal; and causing the remote control to send back a device code that unambiguously identifies the remote control, wherein the remote control is differentiated by the device code from another remote control associated with the same group number.

2. A base station, comprising: a transceiver including:

an arrangement for delivering a search signal and an identification signal, an arrangement for receiving a contact signal and a device code from a remote control, and an arrangement for performing at least one of a triggering operation and an analyzing operation with respect to a signal to be at least one of sent and received by the transceiver;

wherein the transceiver delivers the identification signal on receipt of a contact signal associated with the remote control and the identification signal causes every remote control receiving the identification signal to send back a respective device code identifying unambiguously every remote control receiving the identification signal.

3. The base station according to claim 2, further comprising:

a microprocessor for testing a device code received from the remote control in order to achieve an unambiguous interpretability.

4. The base station according to claim 3, wherein:

the transceiver delivers a separation signal when the device code cannot be interpreted unambiguously.

5. The base station according to claim 4, wherein:

the transceiver delivers a blocking command for suppressing a transmission of subsequent contact signals by other remote controls on receipt of a first contact signal in response to the separation signal.

6. The base station according to claim 3, wherein:

the microprocessor analyzes received contact signals for a time of receipt with respect to a transmission of the search signal in order to identify an operating element.

7. A remote control, comprising:

a transceiver including:

an arrangement for receiving a search signal and an identification signal, an arrangement for delivering a contact signal and a device code, wherein the contact signal is delivered after a period of time characteristic of the remote control and determined by a group number has elapsed after receipt of the search signal, and an arrangement for performing at least one of an analyzing operation and a triggering operation with respect to a signal to be at least one of received and sent.

8. The remote control according to claim 7, wherein:

the transceiver delivers the device code on receipt of the identification signal.

9. The remote control according to claim 7, wherein:

the transceiver receives a separation signal, and the transceiver prepares a delivery of the contact signal in a randomly selected time window on receipt of the separation signal.

10. A device, comprising:

a base station provided with a first transceiver including:

an arrangement for delivering a search signal and an identification signal, an arrangement for receiving a contact signal and a device code from a remote control, and an arrangement for performing at least one of a triggering operation and an analyzing operation with respect to a signal to be at least one of sent and received by the transceiver; and a plurality of remote controls, each remote control provided with a respective second transceiver including:

an arrangement for receiving the search signal and the identification signal, an arrangement for delivering the contact signal and the device code, wherein the contact signal is delivered after a period of time characteristic of the remote control and determined by a group number has elapsed after receipt of the search signal, and an arrangement for performing at least one of an analyzing operation and a triggering operation with respect to the signal to be at least one of received and sent, wherein each one of the remote controls is identified by respective group numbers, and wherein at least one group number is assigned to multiple remote controls at the same time.

* * * * *